United States Patent [19]

Morgan

[11] Patent Number: 4,621,886

[45] Date of Patent: Nov. 11, 1986

[54] CONNECTOR WITH STRAIN RELIEF

[75] Inventor: Thomas E. Morgan, Concord, Ohio

[73] Assignee: Minnesota Mining and Manufacturing Company, St. Paul, Minn.

[21] Appl. No.: 672,824

[22] Filed: Nov. 19, 1984

[51] Int. Cl.[4] ..... H01R 13/58

[52] U.S. Cl. ..... 339/107; 339/105

[58] Field of Search ..... 339/105, 107, 98, 99, 339/17 F, 17 G, 17 MF

[56] References Cited

U.S. PATENT DOCUMENTS

| | | | |
|---|---|---|---|
| 444,450 | 4/1984 | Huber | 339/107 |
| 4,269,466 | 5/1981 | Huber | 339/107 |
| 4,548,460 | 10/1985 | Dozsa et al. | 339/17 F X |

*Primary Examiner*—Eugene F. Desmond

*Attorney, Agent, or Firm*—Renner, Otto, Boisselle & Lyon

[57] ABSTRACT

An electrical connector includes a pair of opposed plastic strain relief bodies having opposed cable end portions forming therebetween at opposed inner surfaces a laterally elongate narrow slot of a width sufficient to accommodate the width of a ribbon cable. The connector also includes relatively rigid elongate reinforcing members such as metal bars which outwardly engage the cable end portions of the strain relief bodies and clamp such cable end portions together. The metal bars are held in clamping relationship by fasteners at the ends thereof extending laterally beyond respective ends of the narrow slot. Each metal bar engages an outwardly facing surface of the cable end portion of the respective strain relief body over substantially the full width of the slot thereby to prevent or minimize bowing of the cable end portions upon flexing of the cable relative to the strain relief bodies.

7 Claims, 6 Drawing Figures

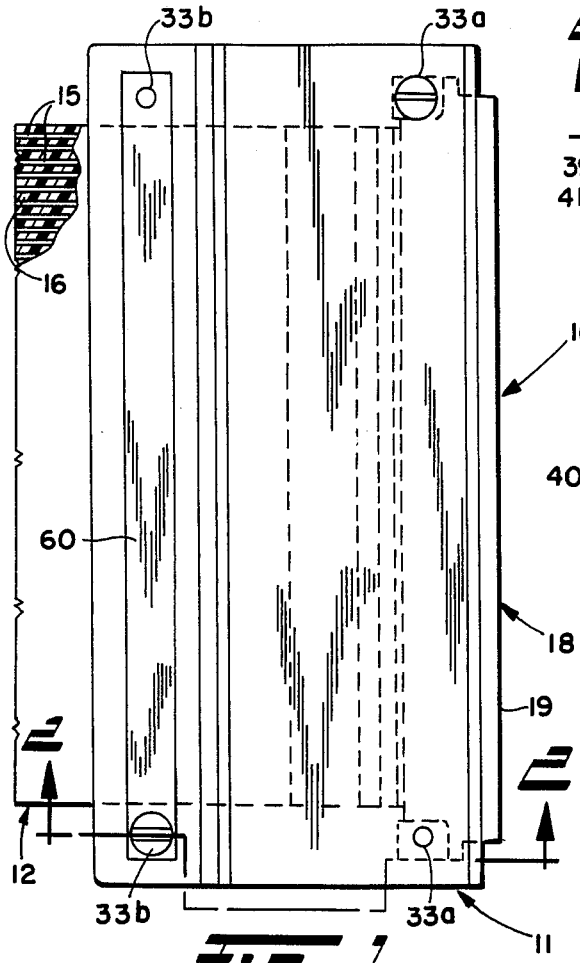
FIG. 1
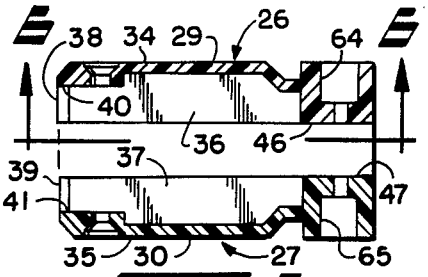
FIG. 5
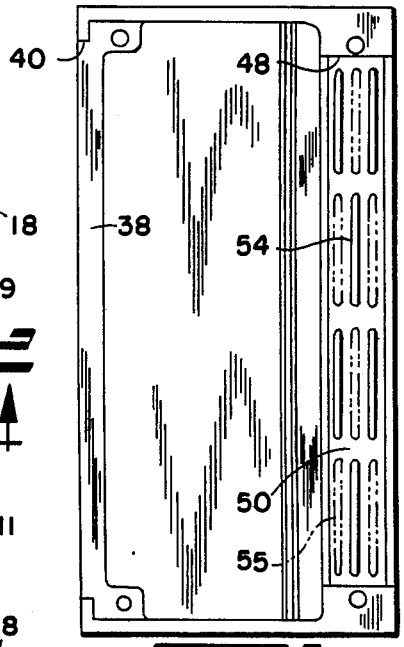
FIG. 6
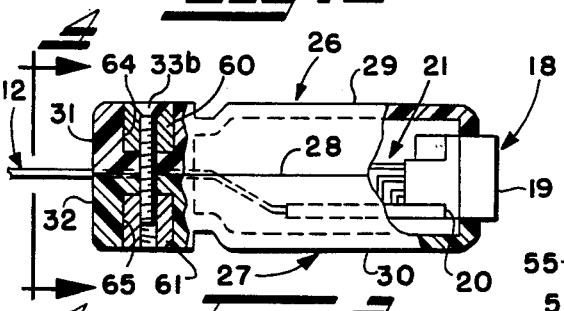
FIG. 2
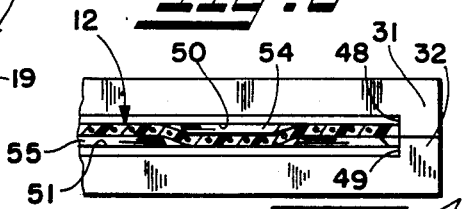
FIG. 4
FIG. 3
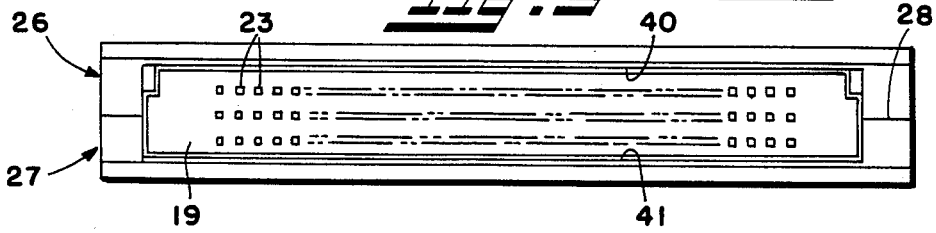

CONNECTOR WITH STRAIN RELIEF

The invention herein disclosed relates generally to a multiple conductor electrical connector and, more particularly, to such a connector that may be used in conjunction with a multi-conductor cable as of the flat or ribbon type to form a cable termination assembly having improved strain relief.

BACKGROUND

Multi-conductor cables have enjoyed widespread use in the electronics industry. One such multi-conductor cable, commonly referred to as flat or ribbon cable, includes plural wire conductors contained in a common plane and electrically isolated from each other by electrically nonconductive insulation. The insulation may be of various materials such as polytetrafluoroethylene (Teflon) which characteristically is quite slippery and difficult to grip firmly without damage to the insulation or relatively fine wire conductors. Ribbon cable utilized for high speed signal transmission as in computers and other electronic equipment may have, for example, 64 signal wires and 128 ground wires within a cable width of 3.25 inches.

For convenience in connection to and disconnection from other electrical devices, various types of electrical connectors such as multiple pin-out connector plugs (sockets) have been employed to terminate the ribbon cable or, more particularly, the cable conductors at respective contacts (either male or female) for electrical coupling to respective contacts of another electrical device. Because of the relatively small size and closely packed relationship of the conductors and contacts and the usually relatively fragile electrical and mechanical junctions between respective conductors and contacts, the electrical connectors are usually provided with some form of strain relief protecting the electrical junctions, contacts and/or conductors from breakage during manipulation of the cable termination assembly.

One practice has been to mold a strain relief body directly about a part of the cable and the electrical junctions as well. The molded strain relief body would serve to dissipate forces tending to separate the cable from contacts which also may be anchored in the molded strain relief body.

SUMMARY OF THE INVENTION

The present invention overcomes the aforesaid problem found to result from bowing or deflection of the strain relief bodies away from the cable along the width of the cable slot as when the cable is flexed relative to such bodies. The invention also advantageously solves the problem in an inexpensive manner and without undesirable increase in size or weight of the cable termination assembly.

In accordance with the invention, there is included in an electrical connector a pair of opposed strain relief bodies formed from electrically nonconductive material such as plastic. The strain relief bodies have opposed cable end portions forming therebetween at opposed inner surfaces a laterally elongate narrow slot of a width sufficient to accommodate the width of the ribbon cable. The connector also includes relatively rigid elongate reinforcing members such as metal bars which outwardly engage respective cable end portions of the strain relief bodies and clamp such cable end portions together. The reinforcing members are held in clamping relationship by fasteners at the ends thereof extending laterally beyond respective ends of the narrow slot. Each reinforcing member engages an outwardly facing surface of the slot forming portion of the respective strain relief body over substantially the full width of the slot thereby to prevent or minimize bowing of the cable end portions upon flexing of the cable relative to the strain relief bodies. Also, laterally extending ribs or beads are provided on the slot forming surfaces of the strain relief bodies to lock the cable securely through deformation against pull-out and lateral shifting. Such beads are arranged in respective rows in laterally staggered relationship not only to deform the cable along one or more laterally extending bends but also along one or more longitudinally extending bends to a limited extent short of damaging the cable.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 1 is a top plan view, partly broken away in section, of a cable termination assembly according to the present invention;

FIG. 2 is a side elevational view, partly broken away in section, of the cable termination assembly looking generally in the direction of the arrows 2—2 of FIG. 1;

FIG. 3 is a front elevational view of the cable termination assembly of FIG. 1;

FIG. 4 is an enlarged fragmentary back elevational view of the cable termination assembly (in section through the cable) looking generally in the direction of the arrows 4—4 of FIG. 2;

FIG. 5 is a reduced exploded sectional view of the strain relief bodies employed in the cable termination assembly; and FIG. 6 is a plan view of one strain relief body looking generally in the direction of the arrows 6—6 of FIG. 5.

DETAILED DESCRIPTION

Referring now in detail to the drawings and initially to FIGS. 1-4, a cable termination assembly in accordance with the present invention is generally indicated at 10. The cable termination assembly 10 includes an electrical connector or cable termination 11 and a cable 12, which in the preferred embodiment is a multi-conductor flat or ribbon type cable. Although the invention will be described below with reference to the preferred cable type, it will be appreciated that the invention may be employed in connection with other types of multi-conductor cables as well as with a plurality of single conductor cables. It is a basic function of the cable termination assembly to connect a large number of the conductors in the cable or cables to external devices, such as terminal boards, computer modules, circuit boards, other cables via similar but opposite connectors, etc. It is, of course, desirable that the electrical connections made by the cable termination assembly have a high level of integrity for optimum electrical signal transmission purposes.

In the illustrated preferred embodiment, the cable 12 includes a plurality of electrical conductors 15 contained in and electrically isolated from each other by electrical insulation 16. Some of the conductors may be signal carrying conductors and some may be ground isolation conductors located intermediate respective adjacent signal carrying conductors in the common plane of the conductors. By way of example, there may be 64 signal wires and 128 ground wires within the cable having a width of approximately 3.25 inches. The invention may be used with cables having fewer or more conductors and narrower or wider width dimensions.

The electrical connector or cable termination 11 includes a contact carrier subassembly 18 consisting of a multiple pin connector element 19 and a printed circuit board 20. For the above exemplary cable, the multiple pin connector element 19 may be a 96-pin (DIN plug) connector including 96-pin contacts connected by leads, collectively indicated at 21, to respective circuit paths of the PC board 20. The contacts of the DIN plug are mounted in a molded carrier/plug body including plural rows of evenly spaced openings 23 which are operative to guide respective pins of another electrical device into aligned engagement with respective contacts mounted in the plug body.

The contact carrier subassembly 18 is located between a pair of molded strain relief bodies 26, 27 which mate along a parting line or plane 28 and form a housing for the subassembly 18. The strain relief bodies are generally similar in configuration, each having a plug housing end portion 29, 30 and a cable end portion 31, 32 in opposition to respective portions of the other body when such bodies are mated and secured by fasteners such as screws 33 located generally at the four corners of an overall rectangular configuration of the connector.

With additional reference to FIGS. 5 and 6, the plug housing end portion 29, 30 of each strain relief body 26, 27 has a transversely extending top (bottom) wall 34, 35, depending side walls 36, 37 terminating at the parting line 28, and a front end wall 38, 39. When the strain relief bodies are mated in opposition to one another, the top (bottom) wall (34, 35), side walls (36, 37), and front end walls (38, 39) together interiorly define a compartment for receiving the contact carrier subassembly 18 in the manner shown. The front end walls 38, 39 of the strain relief bodies also have respective recesses 40, 41 extending substantially over the width of the strain relief bodies which recesses together form a generally rectangular opening through which the forward end of the DIN plug 19 extends for desired presentation to another device for coupling therewith. The DIN plug may be securely held in place by the two screws 33*a* at the front corners of the connector, such screws extending from one strain relief body through bores in respective end portions of the DIN plug for threaded receipt in the other strain relief body.

The cable end portion 31, 32 of each strain relief body 26, 27 generally is in the form of a laterally extending, rectangular shape block. The end portions 31 and 32 have juxtaposed parting faces 46, 47 each recessed at 48, 49 to form therebetween a laterally elongate narrow slot extending substantially the width of the end portions. The bottom surfaces 50, 51 of the recesses 48, 49 define therebetween a nip operative to clamp therebetween the cable 12 when the strain relief bodies are secured together by the screws 33.

As shown, the bottom surfaces 50, 51 of the recesses 48, 49 preferably are provided with some form of cable deforming means to provide an interlock between the cable 12 and the cable end portions 31, 32 of the strain relief bodies 26, 27. As seen in FIG. 6, the bottom surface 50 of the cable end portion 31 may have formed thereon laterally extending beads or ridges 54 arranged in laterally extending rows with the beads in each row staggered in relation to those in the adjacent row. The bottom surface 51 of the other cable end portion 32 similarly may have formed thereon laterally extending beads or ridges with the beads in each row thereof staggered in relation to the beads 54 in the corresponding row of beads provided on the cable end portion 31 as indicated at 55 by broken line projections in FIG. 6.

With such arrangement, the bottom surfaces 50, 51 of the cable end portions 31, 32, preferably provided with the beads 54, 55 thereon, cooperate to clamp the cable 12 therebetween when the strain relief bodies are mated and secured together by the screws 33*b* at opposite lateral ends of the cable end portions. The beads operate to deform the cable along plural laterally extending bends and also along longitudinally extending bends to a limited extent short of damaging the cable.

As will be appreciated, such clamping and deforming results in reactionary forces imparted to the strain relief bodies cable end portions 31, 32 in a direction tending to separate the cable end portions from mated engagement. Although separating movement is precluded at the lateral ends of the cable end portions by the screws 33*b* securing such ends together tightly, there is no such secure restraint of the cable end portions over their intermediate lengths between which the cable 12 is clamped. Being made of plastic material, the cable end portions have a tendency to bow and thus separate along their intermediate lengths because of the developed reactionary forces which, if not prevented, may result in slippage of the cable relative to the strain relief bodies and the components housed therein. This especially would be a problem if the cable has a width considerably less than that of the slot forming recesses 48, 49 and thus the spacing between the screws 33*b* securing opposite ends of the cable end portions together.

In accordance with the present invention, such bowing and separation of the cable end portions 31, 32 of the strain relief bodies 26, 27 is prevented by the provision of a pair of elongate reinforcing members 60, 61 having greater rigidity than the cable end portions. The reinforcing members 60, 61 extend laterally in relation to the cable 12 and outwardly engage the cable end portions or respective slot forming portions thereof so as to apply clamping forces to such cable end portions over the full widths of the slot forming recesses 48, 49 or a substantial portion thereof intermediate the screws 33*b* which secure or hold the reinforcing members in clamping relationship.

In the illustrated embodiment, the reinforcing members 60, 61 are in the form of metal bars of rectangular cross section. The bars 60, 61 are received in correspondingly sized sockets 64, 65 in the cable end portions at their outer sides opposite the cable accommodating recesses 48, 49. As shown, the bottom surface of each socket is preferably parallel to and spaced from the bottom surface 50, 51 of the respective recess 48, 49 by a web part of the respective cable end portion 31, 32. The lateral ends of each bar extending laterally beyond respective ends of the respective cable accommodating recess are provided with holes for passage or threaded receipt of the screws 33*b*. Preferably the bars 60, 61 are identical, each having at one end an unthreaded, counter-sunk screw receiving hole and at the other end a threaded screw retaining hole. Therefore, in use the screws 33*b* at opposite ends of the bars are inserted from opposite directions to balance forces on the bars and cable end portions 31, 32 drawing the bars toward each other. The number of parts for the connector can be minimized, too, because of the identity of the bars 60, 61.

In view of the foregoing, there is provided an electrical connector including a pair of opposed strain relief bodies wherein slippage of a multi-conductor cable or the like relative to the strain relief bodies is effectively precluded thereby to minimize the possibility of breakage of the cable conductor/contact connections.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the following claims.

I claim:

1. An electrical connector comprising a planar arrangement of multiple conductors; a pair of opposed, plastic strain relief bodies having housing end portions forming therebetween a housing for terminating means for said conductors and cable end portions forming therebetween a laterally elongate narrow slot of a width greater than that of said planar arrangement, said cable end portions having at said slot opposed inside surface means operative to engage and hold said planar arrangement of multiple conductors extending longitudinally through said slot from outside said bodies to the interior of said housing for connection to said terminating means; respective relatively rigid reinforcing means for stiffening each cable end portion against flexure along its width in the area of said surface means; and means at respective lateral ends of said reinforcing means for urging said reinforcing means towards one another and against said cable end portions to cause a clamping force to be applied by said cable end portions upon the cable at said surface means substantially across the full width of said planar arrangement of multiple conductors; said surface means including means for deforming said planar arrangement of multiple conductors; said planar arrangement of multiple conductors being a flat multi-conductor cable, said means for deforming including a plurality of protrusions operative to deform respective portions of said cable, said protrusions including laterally extending narrow beads arranged to deform the cable along plural laterally extending bends and along plural longitudinally extending bends to a limited extent short of damaging the cable, thereby securely to lock said planar arrangement of multiple conductors between said cable end portions to prevent forces applied to said planar arrangement from being transferred to said terminating means, said beads being arranged in plural rows in laterally staggered relationship, said beads on each of said strain relief bodies being staggered in relation to the relatively adjacent beads on the other, said reinforcing means including respective elongate metal bars which outwardly engage respective cable end portions of said strain relief bodies, and said means for urging including fastener means for holding said bars engaged against said cable end portions to clamp said cable end portions together.

2. A connector as set forth in claim 1, wherein said cable end portions include laterally extending sockets containing said metal bars.

3. A connector as set forth in claim 1, wherein said fastener means includes a fastener at opposite ends of said bars extending laterally beyond respective sides of said planar arrangement.

4. A connector as set forth in claim 1, wherein said fastener means includes a pair of screws, each respectively being located near a respective end of both bars for drawing said bars toward each other.

5. A connector as set forth in claim 4, wherein said bars have openings at each end for receiving said screws, one of such openings in each bar being threaded for securement with a respective screw inserted through the relatively aligned opening in the other bar, and said screws being inserted from opposite sides of the connector.

6. A strain relief device for electrical connectors or the like including a part of a flat multi-conductor cable, said device comprising a pair of plastic strain relief bodies mateable to form therebetween a laterally elongate narrow slot, said bodies having at such slot opposed inside surface means operative to engage and hold a cable extending longitudinally through said slot; respective relatively rigid reinforcing means for stiffening said body portions in the area of said surface means; and means at respective lateral ends of said reinforcing means for urging said reinforcing means towards one another and against said strain relief bodies to apply a clamping force upon the cable substantially across the full width thereof at said surface means; said surface means including a plurality of laterally extending narrow protrusions arranged on each of said strain relief bodies in laterally and longitudinally staggered relation to one another to deform the cable along plural laterally extending bends and plural longitudinally extending bends to a limited extent short of damaging the cable, thereby securely to lock said cable in said strain relief device to prevent forces applied to the cable from being transferred across said slot, the protrusions on each of said strain relief bodies being arranged in plural longitudinally spaced apart rows with the protrusions in each row being laterally staggered in relation to the protrusions in an adjacent row, said bodies having laterally extending sockets spaced outwardly from respective said surface means, and said reinforcing means including elongate metal bars fixable in said sockets.

7. A device as set forth in claim 6, wherein said sockets and bars are of corresponding rectangular cross-section.

* * * * *